US006671903B2

(12) United States Patent
Bowers et al.

(10) Patent No.: US 6,671,903 B2
(45) Date of Patent: Jan. 6, 2004

(54) WALKING BAG

(76) Inventors: Douglas Bowers, P.O. Box 281, Nenana, AK (US) 99760; Rebecca Bowers, P.O. Box 281, Nenana, AK (US) 99760

( * ) Notice: Subject to any disclaimer, the term of this patent is extended or adjusted under 35 U.S.C. 154(b) by 0 days.

(21) Appl. No.: 10/124,650

(22) Filed: Apr. 18, 2002

(65) Prior Publication Data

US 2002/0170112 A1 Nov. 21, 2002

Related U.S. Application Data

(60) Provisional application No. 60/291,260, filed on May 17, 2001.

(51) Int. Cl.[7] ..... A47C 29/00; A41D 15/04

(52) U.S. Cl. ..... 5/413 R; 2/69.5

(58) Field of Search ..... 5/413 R; 2/69.5, 2/69, 79

(56) References Cited

U.S. PATENT DOCUMENTS 3,924,273 A * 12/1975 Donovan ..... 2/69.5
4,103,377 A * 8/1978 Mayer et al. ..... 2/69.5
4,158,892 A * 6/1979 Gonzales ..... 2/69.5
4,206,512 A * 6/1980 Osborne ..... 2/69.5
4,484,362 A * 11/1984 Asher ..... 2/69
4,507,805 A * 4/1985 Calutoiu ..... 2/69.5
4,547,906 A * 10/1985 Nishida et al. ..... 2/93
4,574,397 A * 3/1986 Dennard ..... 2/69.5
4,575,876 A * 3/1986 Weaver ..... 2/69.5
4,605,029 A * 8/1986 Russell ..... 135/125
4,674,130 A * 6/1987 Coudron ..... 2/69.5
6,061,831 A * 5/2000 Rudolph et al. ..... 2/69.5

* cited by examiner

*Primary Examiner*—Teri Pham Luu

(57) ABSTRACT

An invention of two parts for use as a sleeping bag and ambulatory garment comprising a body portion and two leg portions integral with the body portion which covers the human body from shoulders to the ankles. A two part system for use in cold weather or survival situations allowing for the ability to be able to move around, thereby generating body heat and be able to perform tasks as particular situations may require, taking up the approximate space of a conventional sleeping bag. The invention includes an auxillary insulated foot bag to provide additional insulation to the feet and lower legs. This invention does not use nor require the use of releasable fastening means and devices.

1 Claim, 3 Drawing Sheets

WALKING BAG

CROSS REFERENCE TO RELATED APPLICATIONS

Provisional Pat. No. 60/291,260, filed May 17, 2001 Final patent application #10/124,650, Art Unit 3673

STATEMENT REGARDING FEDERALLY SPONSORED RESEARCH OR DEVELOPMENT

Not federally sponsored.

BACKGROUND OF THE INVENTION

The conventional sleeping bag serves one function only and has done well for several hundred years. As dog mushers and manufacturers of related outdoor gear and clothing we have found conventional sleeping bags to be cumbersome and restrictive for movement. If used as a piece of survival equipment the conventional sleeping bag can only be used for resting or sleeping, therefore no body heat is generated by movement resulting in further chilling. The sleeping bag cannot be used for the wearer helping themselves or others out of a "survival" situation.

If the sleeping bag user needs to relieve themselves or tend to other business such as required in a survival or cold weather situations, they have to struggle out of the sleeping bag, place their warm feet in cold footgear (as winter footgear doesn't readily fit in conventional sleeping bags), take care of business—then return, remove their now chilled feet from the cold footgear and replace them in a now cold sleeping bag, further reducing body temperature by having to rewarm the sleeping bag. Additionally, the user now has to fumble with a sub-zero, metal zipper pull or velcro (both so prone to failure) and has now, perhaps, frostbitten a couple fingers, further adding to the discomfort and having to start the warming process all over again. Or, if the zipper has jammed spend, at the least, a long uncomfortable night.

BRIEF SUMMARY OF THE INVENTION

Our Walking Bags solves the previously mentioned problem by allowing freedom of movement by constructing a "sleeping bag with legs" coupled with a short auxillary over bag(foot bag) to provide additional insulation for the feet and legs while resting. The Walking Bag is constructed large enough to accommodate all the clothing (parka, wind parts, etc.) the user may be wearing including footgear. That way when physical movement is necessary all the user need do is kick off the separate foot bag and stand up. The Walking Bag is also an auxillary source of insulation in which a person can rewarm themselves after getting chilled or wet and to keep warm after physical exertion to prevent chilling. The arms can be either inside or outside the Walking Bag as needed for mobility or heat retention as situations would call for.

#1 references to suspender of which there are two.

#2 references the leg openings.

Figure 1:
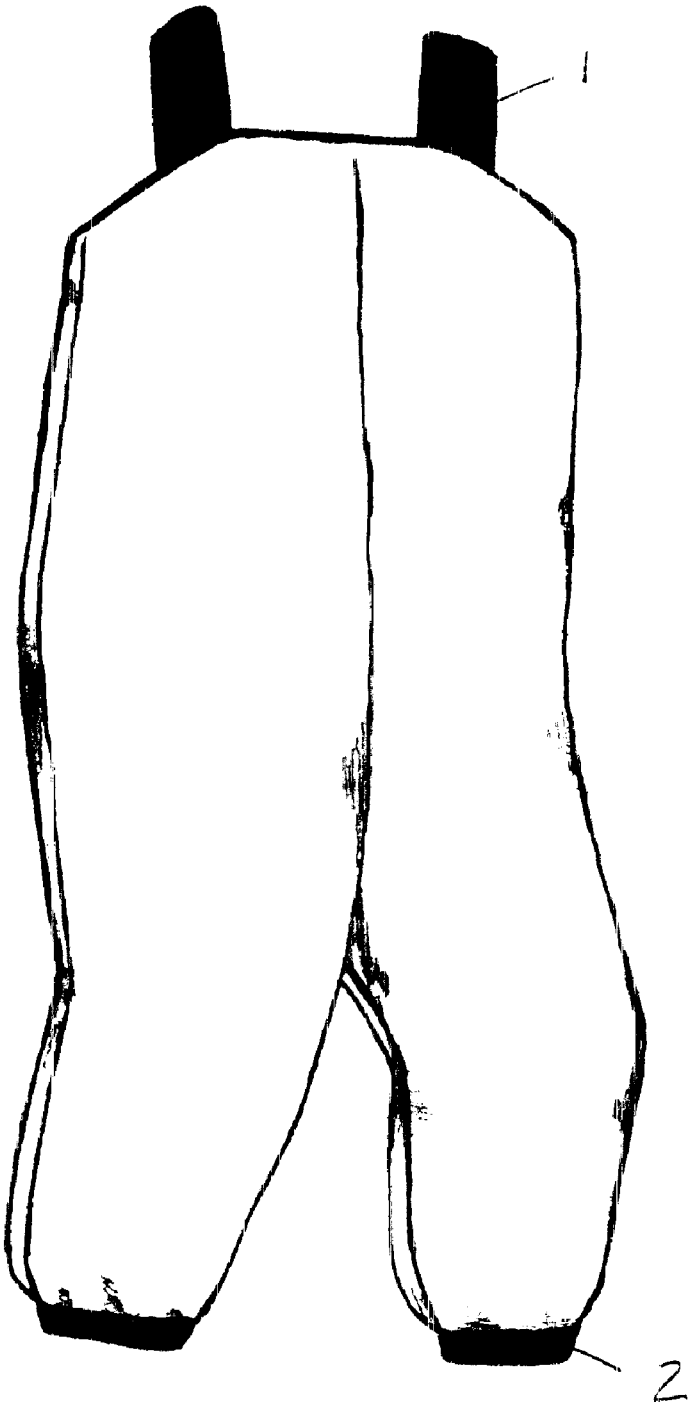
FIG. 1. Shows the Walking Bag, there are no releasable fastening devices and means to fail or jam or manipulate with cold stiff fingers. It is a slip on—step into affair.
Figure 2:
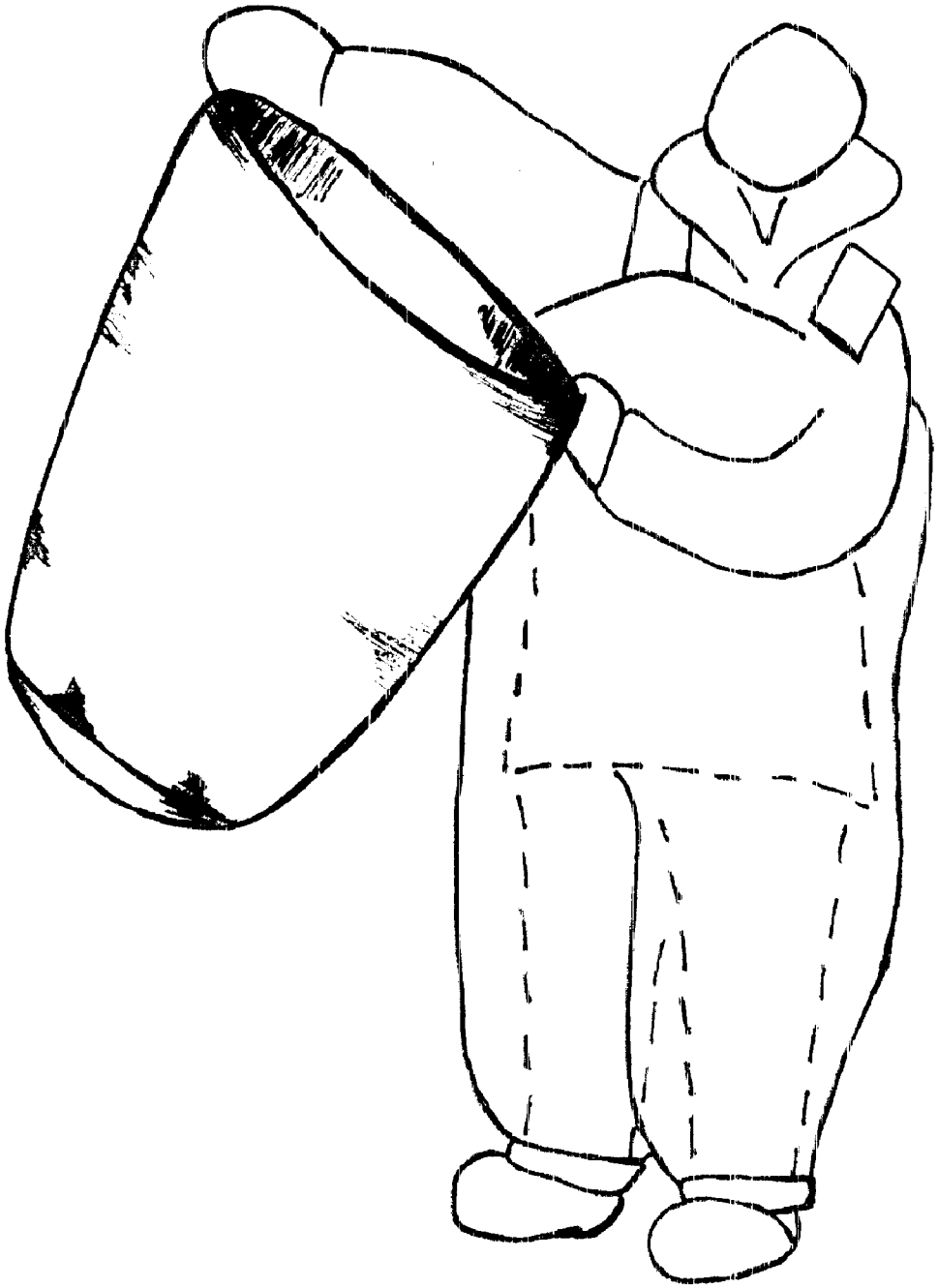

FIG. 2. Shows the Walking Bag as it would be worn with the wearer holding the auxillary foot bag that provides additional insulation for the feet and legs.

Figure 3:
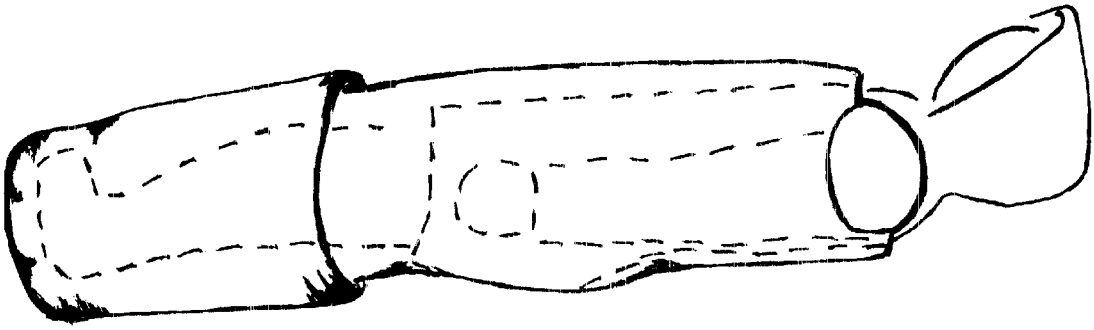

FIG. 3. Shows the wearer in the reclining position wearing the complete walking bag system, the foot bag is shown covering the feet and lower legs.

DETAILED DESCRIPTION OF THE INVENTION

Both components are cut from patterns and edges joined. All seems and finished edges are multiply attached and finished in such manner to minimize the possibility of failure. The outer shell fabric should be a touch, tear resistant breathable fabric. The middle layer(s) is insulation, preferably of a type, that will retain insulative qualities when wet. The inner layer is a "slippery" fabric (e.g. nylon) to allow for ease of entry and exit. Wide fabric or elastic is attached for the suspenders of the walking bag. Elastic may be attached to the bottoms of the legs to keep the legs from riding up and minimize the possibility of drafts. There are no zippers, snaps, buckles or other releasable fastening devices or means to fail.

What is claimed is:

1. A sleeping bag comprising an insulated garment portion and an insulated bag portion, said garment portion having a body portion with a central entrance at a head end thereof, suspenders attached to the body portion, and a leg portion having two leg receiving passages;

wherein the garment portion covers a human torso front and back from approximately neck level to the ankles with entrance to the garment portion gained from the head end, said garment portion being supported by said suspenders from the shoulders and said bag portion being drawn over the feet and lower legs to provide additional insulation.

* * * * *